United States Patent [19]

Muramatsu et al.

[11] Patent Number: 4,788,393

[45] Date of Patent: Nov. 29, 1988

[54] DIP ROTARY CODE SWITCH

[75] Inventors: Masayuki Muramatsu; Atsuo Yamazaki, both of Iruma, Japan

[73] Assignee: Copal Electronics Co. Ltd., Tokyo, Japan

[21] Appl. No.: 878

[22] Filed: Jan. 6, 1987

[30] Foreign Application Priority Data

Jan. 29, 1986 [JP] Japan ..... 61-017305

[51] Int. Cl.[4] ..... H01H 19/58; H01H 21/78

[52] U.S. Cl. ..... 200/292; 200/155 R; 200/275; 200/11 DA; 200/11 TW; 200/11 G

[58] Field of Search ..... 200/11 D, 11 DA, 11 A, 200/11 H, 292, 336, 11 R, 11 G, 11 TW, 11 K, 155 R, 291, 275

[56] References Cited

U.S. PATENT DOCUMENTS

| | | | |
|---|---|---|---|
| 3,264,419 | 2/1966 | Handel et al. | 200/11 D |
| 3,350,530 | 10/1967 | Fry | 200/292 |
| 3,371,167 | 2/1968 | Soulakis, Jr. | 200/155 R |
| 3,518,389 | 6/1970 | Doering, Jr. et al. | 200/336 |
| 3,668,338 | 6/1972 | O'Malley | 200/11 A |
| 3,699,279 | 10/1972 | Lockard et al. | 200/11 G |
| 3,912,886 | 10/1975 | Allen et al. | 200/11 A |
| 4,052,573 | 10/1977 | Kojima et al. | 200/11 DA |
| 4,481,386 | 11/1984 | Rose | 200/11 R |
| 4,493,954 | 1/1985 | Kimmel et al. | 200/11 R |

FOREIGN PATENT DOCUMENTS 59-114713 2/1984 Japan .

*Primary Examiner*—Henry J. Recla
*Assistant Examiner*—Ernest G. Cusick
*Attorney, Agent, or Firm*—Wenderoth, Lind & Ponack

[57] ABSTRACT

A DIP rotary code switch provided with a plurality of terminals arranged on a circuit board embedded in a base includes a rotor, conductive patterns disposed, on the bottom surface of the rotor the rotor being rotatably mounted in a cavity formed by a housing and a base, a contact member holder having a center boss on the upper surface thereof which rotatably supports the rotor and having slots extending therethrough and a contact member provided with an apex head fitted respectively into a slot extending through the contact member holder, the apex head intermittently contacting conductive patterns of the rotor when rotated and the contact member having two legs fitted respectively into slits extending in a the base to be electrically connected to conductive elements arranged on the surface of the circuit board embedded in the base.

4 Claims, 3 Drawing Sheets

DIP ROTARY CODE SWITCH

BACKGROUND OF THE INVENTION

1. Field of the Invention

This invention relates to the field of a rotary code switches and more particularly to the improvement of a contact member of a rotary code switch of the dual-in-line-package type (hereinafter called DIP rotary code switch).

2. Description of the Related Art

A rotary code switch having a "dual-in-line-package" structure is small and has been developed for installation on a printed circuit board equipped with electronic components and control devices.

A conventional DIP rotary code switch includes: a base made of insulative material in which a circuit board is embedded; a plurality of terminals which may comprise a common terminal, a pull-up terminal and a plurality of output terminals arranged on the circuit board; a plurality of contact members each having an inverted V-shape comprised of two legs and an apex arranged underneath a rotor which is rotatably mounted within a cavity formed by a housing and the base. A disc or substrate is mounted for rotation with the rotor. Various patterns of conductive material devised to meet the desired purposes of the switch are arranged on the lower surface of the disc or substrate which is rotatably mounted on a boss of the base so as to be simultaneously rotatable with the rotor.

When the rotor and the disc rotate, the patterns of conductive material of the disc may intermittently contact the apex head of the contact member whose two legs are mounted in longitudinal slits of the base respectively to touch conductor elements arranged on a circuit board which is embedded in the base and to which plate terminals are connected, thereby resulting in electrical connection or disconnection of the plate terminals.

Such a rotary code switch has been invented by the present inventor and is disclosed in Japanese Provisional Patent Publication No. 114713/1984. The switch is provided with plate terminals comprising a common terminal, a pull-up terminal and a plurality of output terminals. The arrangement of the plate terminals of the prior art switch is as follows:

a same number of resistance elements and diodes as there are output terminals are, respectively, disposed between the pull-up terminal and the out-put terminals or a same number of diodes as there are output terminals are disposed, respectively, between the common terminal and the out-put terminals. In an IC logical circuit, each signal line is connected to a power line (Vcc) through a resistance for securing a threshold level. Such a system is referred to as "pull-up", and the resistance is called "pull-up resistance". In logics, meanwhile, a common terminal of a switch can be connected to a power line (Vcc) and thus resistance is grounded. The system is referred to as "pull-down".

The contact member adopted by the DIP rotary code switch described heretofore, has an inverted letter V-shaped having two legs and an apex from which the legs extend. The legs are mounted in a longitudinal slit disposed in the base and touch conductor elements arranged on a circuit board embedded in the base and are located underneath the disc which rotates with the rotor. The apex of the contact member slidably engages conductive printed patterns disposed on the undersurface of the disc, whenever the disc is rotated with the rotor. Because the two legs of the contact member are positioned in a longitudinal slit defined in the base, the contact member is shiftable lengthwise within the slit and the apex tends to sway back and forth whenever the disc rotates with its undersurface contacting the apex. Therefore, it is difficult to maintain appropriate contact between the conductive patterns arranged on the undersurface of the disc and the contact member, thereby, resulting in a reduction in the electrical efficiency of the switch.

SUMMARY OF THE INVENTION

It is an object of this invention to provide a holding means for a contact member which helps to maintain the contact member in an appropriate position during the rotation of the rotor.

In the process of assembling the component parts to manufacture the complete DIP rotary switch, two semi-assembling processes are carried out.

The component parts such as a disc and a rotor are assembled to the housing while contact members are assembled to the base by inserting their two legs into longitudinal slits disposed in the base.

When the semi-assembled housing and the base are assembled to complete the DIP rotary switch, the base is inverted onto the housing so that the respective apexes of the contact members may be seated on the disc. When the position of the base is thus inverted, the legs of the contact members are easily slid out of the longitudinal slits to thereby facilitate a smooth assembling of the DIP rotary switch.

It is another object of this invention to provide slits of in a base the structure of which prevent two legs of the contact member from slipping from the base.

These and other objects of the present invention are obtained by a DIP rotary code switch having a plurality of terminals arranged on a circuit board embedded in a base and comprising a rotor having thereof conductive patterns on the bottom surface thereof disposed, the rotor rotatably mounted in a cavity formed by a housing and a base, a plurality of inverted V-shaped contact member provided respectively with a bifurcated leg having an apex head at the top thereof, which leg is fitted respectively into a longitudinal slit disposed in the base, the slit having a rectangular portion at both ends thereof into which a respective one of the legs comprising the bifurcated leg is insertable in such a way that the end of the leg is securely held to make smooth contact on conductive elements arranged on the surface of a circuit board embedded in the base, while the apex head is fitted respectively into a square hole extending in the contact member holder to intermittently contact conductive patterns of the rotor when rotated; and a contact member holder having a center boss on the upper surface thereof which is fitted into a hole disposed in the rotor to rotatably support the rotor, the contact member holder being further provided with square holes into which the apex head is insertable and with a pair of projections protruding from the lower surface of the contact holder member, the pair of projections being respectively fittable into corresponding holes disposed in the base.

Further objects and advantages of the present invention will become apparent from the following detailed description when read in connection with accompanying drawings, and features of novelty which characterize the invention will be pointed out with particularity in the claims annexed to and forming a part of this specification. It is to be expressly understood, however, that the drawings are for the purpose of illustration only and are not intended as defining the limits of the invention.

DESCRIPTION OF THE PREFERRED EMBODIMENTS

Figure 1:
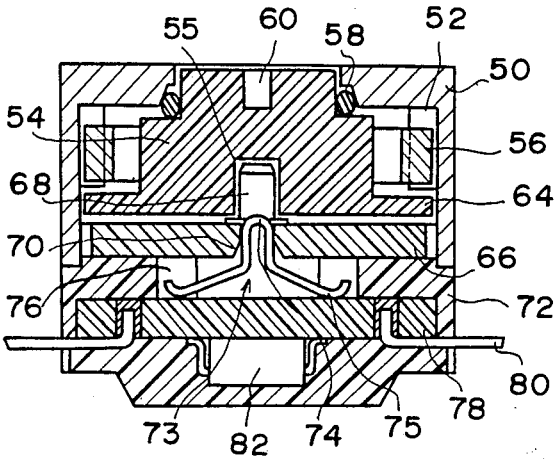
FIG. 1 is a sectional side elevation view of a DIP rotary code switch of the present invention.

The DIP rotary code switch of the invention will be described in detail hereinafter with specific reference to the drawings.

A rotor 54 which is comprised of non-conductive material is rotatably mounted in a cavity formed by a housing 50 and a base 72 also comprised of non-conductive material such as plastic. The rotor 54 is provided with an extended rotor arm 56 an end of which is slidably engaged with a stepped portion 52 disposed inside the housing 50. Numeral 58 designates an O-ring disposed between the housing 50 and the rotor 54.

The rotor 54 is rotated by means of a screwdriver or the like applied to the slot 60 defined in the rotor surface. A conductive pattern 88 is printed and baked on the lower surface 64 of the rotor 54. A non-conductive contact member holder 66 which will hereinafter be described in detail is positioned in a space 90 defined in the base 72 comprised of non-conductive material.

A hole 55 extends in the bottom center of the rotor 54. A boss 68 arranged on the center of the contact member holder 66 is inserted in the hole 55. The space 90 defined in the base 72 is devised to receive the contact member holder 66. Slits 76 extend parallel and through the base 72. Contact members 73 comprised of resilient material each have an inverted V-shape and are comprised of two legs 75 and an apex head 74. The legs are inserted through the slits 76 disposed in the base 72, respectively, to contact conductive elements 100*a*, 100*b*, 100*d* and 100*e* arranged on the surface of an insulative circuit board 78 embedded in the base 72 while the respective apexes extend into square slots 70 disposed in the contact member holder 66 to contact the conductive patterns 88 on the rotor 64. Thus, the contact members 73 are securely held by the contact member holder 66.

Figure 2:
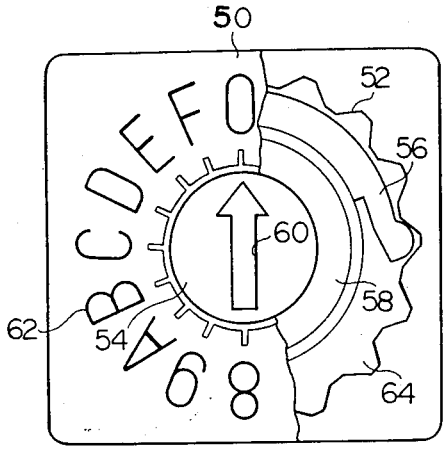
FIG. 2 illustrates is a plan view of the DIP rotary code switch of the invention, partly broken away.

Numeral 82 indicates a diode while numeral 62 shown in FIG. 2 illustrates a scale arranged circumferentially on the housing 50.

Figure 3:
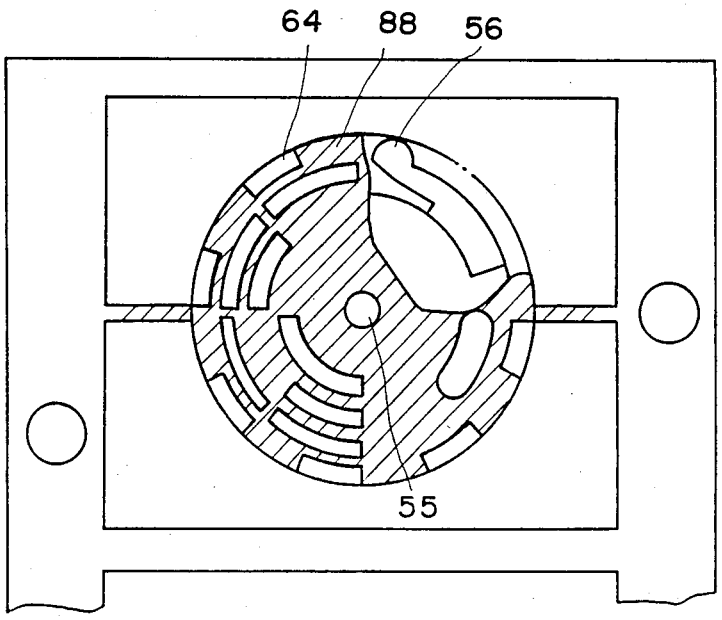
FIG. 3 is an enlarged view of printed patterns disposed on a rotor bottom.
Figure 4:
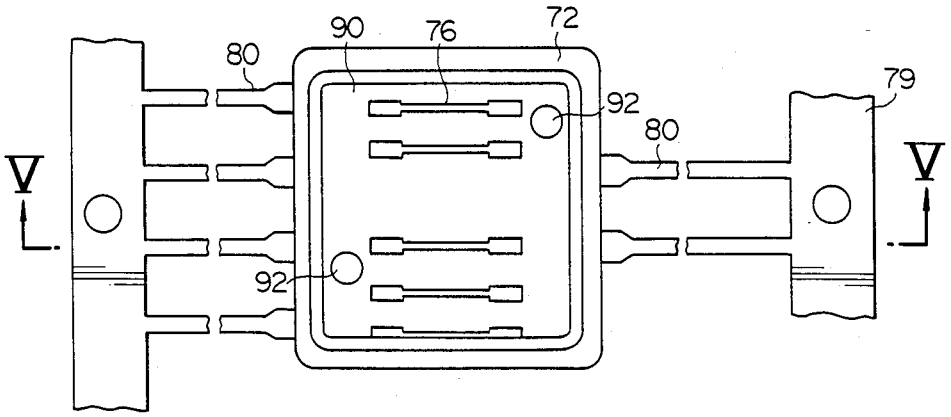
FIG. 4 illustrates is a plan view of a base and plate terminals manufactured by insert molding.

FIG. 3 illustrates the printed conductive pattern 88 disposed on the bottom surface 64 of the rotor 54 comprised of non-conductive material. The base 72 in which the circuit board 78 is embedded is manufactured by plastic insert molding.

Figure 5:
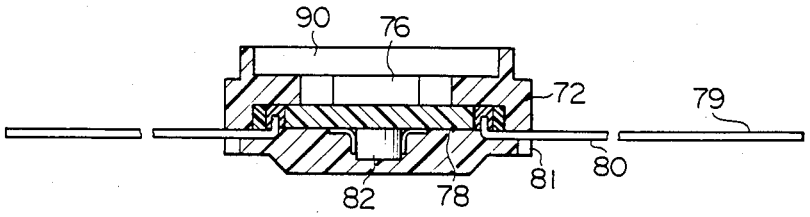
FIG. 5 is a section view taken along line V—V of FIG. 4.
Figure 6:
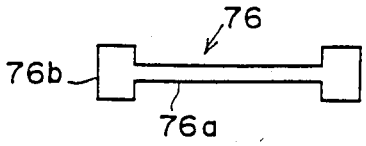
FIG. 6 is a plan view of a slit disposed in the base.
Figure 7:
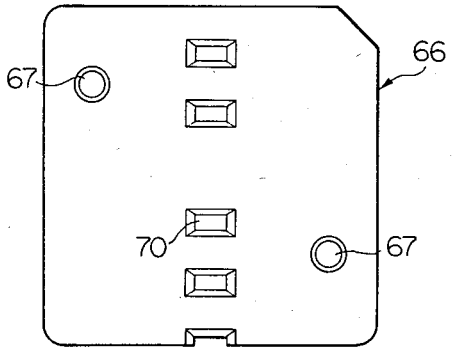
FIG. 7 is a top view of a contact member holder of the present invention.
Figure 8:
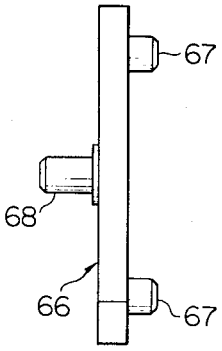
FIG. 8 is a side elevation view of FIG. 7.

Plate terminals 80 are manufactured from one piece of metal 79 by a punching machine and are arranged on the circuit board 78 which is embedded in the base 72, as illustrated in FIG. 5.

The base 72 surrounds the space 90 which may receive the contact member holder means 66. In the bottom of the space 90 are slits 76 into which the legs 75 of the contact member 73 comprised of resilient material may be inserted. The slit 76 includes a narrow section 76*a* open to square sections 76*b* at both ends thereof. Whenever the contact member 73 is assembled with the base 72 and the contact holder 66, the narrow section 76*a* and square sections 76*b* of the slit 76 may receive the two legs 75 of the contact member 73 in such a way that the legs 75 are loosely held in the sections 76*a* and 76*b* to make smooth but not too tight contact with the conductive elements 100*a*, 100*b*, 100*d* and 100*e* arranged on the circuit board 78, as will be explained hereinafter. The square through hole 70 of the contact member holder 66 may receive the apex 74 in such a way that the contact member 73 is held sandwiched between the holder 66 and the base 72. The positioning of the legs 75 loosely held in the square sections 76*a* and 76*b* may contribute to easy assembling of the contact member 73 with the holder 66 and durability of the legs 75 which only contact the conductive members 100*a*. Therefore, even when the switch is held in an inverted position while being assembled, the contact member 73 will not slip out of the slit 76 extending through the base 72, whereby an efficient manufacturing and assembling may be performed. Numerals 92 designates holes extending in the base 72 into which a pair of boss 67 arranged on the bottom of the contact member holder 66 may be removably inserted to accurately position the holder 66 relative to the base 72.

Now referring specifically to FIG. 1, FIG. 9 and FIG. 10, the structure of conductor elements and plate terminals of the present invention will be explained in detail.

Figure 9:
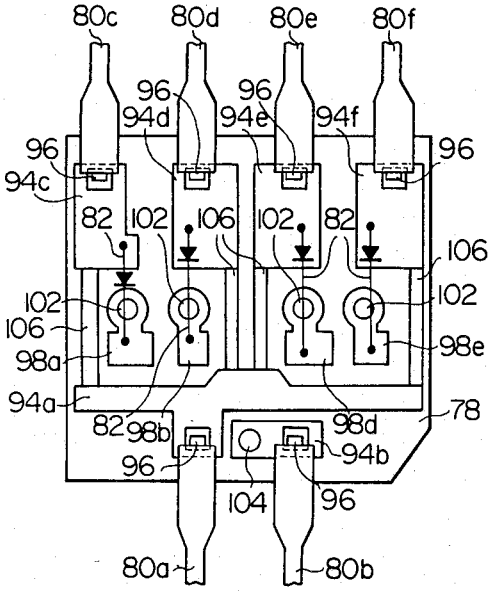
FIG. 9 is a view of a lower surface of a circuit board of the DIP rotary code switch of this invention.
Figure 10:
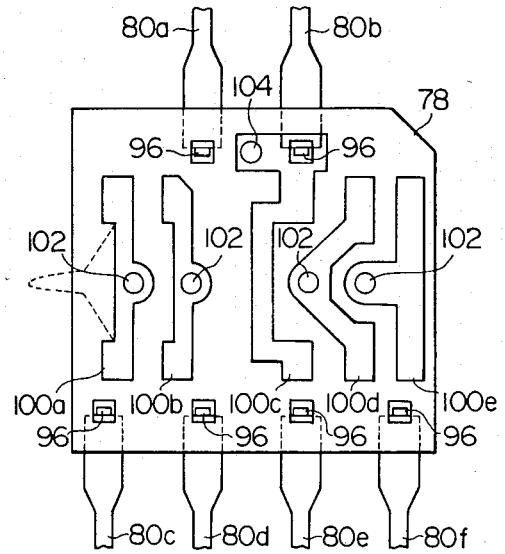
FIG. 10 is a plan view of an upper surface of the circuit board shown in FIG. 9.

FIG. 9 illustrates the bottom surface of the circuit board 78 embedded in the base 72 as shown in FIG. 1. In FIG. 10, a pull-up terminal 80*a* and a common terminal 80*b* are disposed on one side of the circuit board 78 while a plurality of output terminals 80*c*, 80*d*, 80*e* and 80*f* are disposed on the opposite side thereof. The pull-up terminal 80*a* and the common terminal 80*b* are electrically connected to conductor elements 94*a* and 94*b* via square holes 96 respectively by welding. The output terminals 80*c*, 80*d*, 80*e* and 80*f* are also electrically connected to conductor elements 94*c*, 94*d*, 94*e* and 94*f* via a plurality of square holes 96 respectively by welding.

The conductor element 94*a* is also connected to the other conductor elements 94*c*–94*f* disposed on opposite side of the same surface through resistance elements 106. A plurality of conductor elements 98*a*, 98*b*, 98*d* and 98*e* arranged on the lower surface of the circuit board 78 are also electrically connected, by means of through holes 102, to a plurality of conductor elements 100*a*, 100*b*, 100*d* and 100*e* disposed on the other surface (upper surface) of the circuit board 78 respectively. The conductor element 94*b* which is connected to the common terminal 80*b* as explained above is also electrically connected to a conductor element 100*c* arranged on the opposite surface of circuit board 78 via through hole 104.

A plurality of diodes 82 span two groups of conductor elements 98*a*, 98*b*, 98*d*, 98*e* and 94*c*, 94*d*, 94*e*, 94*f* respectively in a similar manner of arrangement as resistance elements 106 and thus, conductor elements of both groups are electrically connected respectively.

The resistance elements and conductor elements as explained heretofore may be printed and baked on the surface of circuit board which is preferably made of ceramics.

The two legs 75 of the contact members 73 are inserted through slits 76 extending through base 72 to contact conductive elements 100*a*, 100*b*, 100*e* arranged on the upper surface of the circuit board 78 respectively while the apex heads 74 inserted into square slots 70 of the contact member holder 66 intermittently touch the desired conductive patterns 88 arranged on the bottom surface of the rotor 54 when the rotor is rotated whereby electrical connection or disconnection between the common terminal 80*b* and the out-put terminals 80*c*, 80*d*, 80*e* and 80*f* may be performed via the pull-up terminal 80, diodes 82 or the resistance elements 106.

Figure 11:
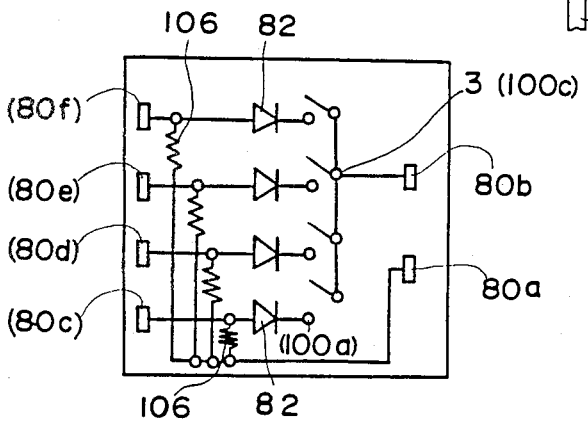
FIG. 11 is an electrical circuit of the DIP rotary code switch of present invention.

FIG. 11 shows an electrical circuit of the DIP rotary code switch of the present invention, wherein a pull-up terminal 80*a* is shown in addition to both a common terminal 80*b* and a plurality of output terminals 80*c*, 80*d*, 80*f*.

The pull-up terminal 80*a* is electrically connected to output terminals 80*c*, 80*d*, 80*e* and 80*f* respectively via resistance element 106 and the diode 82. The number of resistance elements 106 as well diodes 82 being the same as the number of output terminals 80*c*–80*f*.

As the rotor 54 is rotated, for example by the rotation of a screw driver or the like engaged in the slot 60 disposed in the upper end of rotor 54, rotor arm 56 also rotates steppingly engaging with the stepped portions 52 sequentially. The rotation angle of rotor 54 may be shown by a scale figure 62 surrounding an arrowhead of the slot 60. When the rotor 54 thus rotates, supported by the boss 67 of the contact member holder 56 fitted into the center hole 55 thereof, the conductive patterns 88 disposed on the bottom surface of the rotor 54 are each intermittently touched by the apex 74 of contact member 73, whereby an electrical connection or disconnection between the plate terminals including a plurality of output terminals arranged on one side of the circuit board, a common terminal and a pull-up terminal arranged on the other side thereof is performed.

The DIP rotary code switch of this invention is provided with a contact member holder which holds a contact member to maintain the appropriate and accurate position thereof during the rotation of a rotor.

A two leg portion comprising two legs is arranged to be held securely in a slit extending in a base, thereby preventing the leg from slipping therefrom while an apex head thereof intermittently touches conductive patterns disposed on the bottom surface of the rotor during the rotation of the rotor.

Thus, the structure of this invention has an advantage of dispensing with a disc of the prior art which is fitted to a rotor and has conductive patterns on the bottom surface to be contacted by a contact member to perform electrical connection or disconnection between terminals.

What I claim is:

1. A DIP rotary code switch comprising:

a housing and a base and in which a cavity is defined, said base having a plurality of slits extending therethrough, each of said slits including a narrow central section and a respective generally rectangular section open to the narrow section at each end of the narrow central section;

a rotor rotatably mounted in said cavity, said rotor having a lower surface, patterns of electrically conductive material disposed on said lower surface, and a hole that is open to said lower surface;

a contact holder member disposed between said lower surface of the rotor and said base, said contact holder member having a boss extending into said hole of the rotor for rotatably supporting said rotor and said contact holder member also having a plurality of holes extending therethrough, each of said plurality of holes extending through said contact holder member open to both a respective one of the slits extending through said base and the lower surface of said rotor;

a circuit board fixed to said base opposite said contact holder member, the circuit board having electrically conductive elements exposed to the slits extending through said base and a plurality of plate terminals operatively electrically connected to the conductive elements; and a plurality of forked contact members for selectively electrically connecting the patterns of electrically conductive material disposed on the lower surface of said rotor with the conductive elements of said circuit board, each of said plurality of contact members extending respectively in both one of said holes extending through said contact holder member and the slit open to said one of said plurality of holes, and each of said plurality of contact members comprising a pair of legs extending in said narrow section of said slit and fitted therein so as to restrain the contact member from slipping in said slit, each of said pair of legs having a respective free end loosely received in a respective one of said generally rectangular sections of said slit and contacting the conductive elements of said circuit board that are exposed to said slit at the rectangular sections, and each of said contact members also comprising an apex from which said pair of legs extend, said apex loosely received in said one of said plurality of holes and extending therethrough for selectively contacting the conductive material disposed on the lower surface of said rotor as the rotor is rotated.

2. A DIP rotary code switch as claimed in claim 1, wherein each of said contact members has an inverted V-shape.

3. A DIP rotary code switch as claimed in claim 1, wherein said circuit board comprises a common terminal, a pull-up terminal, output terminals, and at least one of a set of resistance elements and a set of diodes for electrically connecting said terminals.

4. A DIP rotary code switch as claimed in claim 1, wherein said base includes a pair of contact member holder mounting holes extending therein, and said contact member holder comprises a pair of projections extending into said contact member mounting holes, respectively.

* * * * *